United States Patent [19]

Hesse et al.

[11] 4,239,317

[45] Dec. 16, 1980

[54] ELECTRICAL CONNECTOR

[75] Inventors: David L. Hesse; Joseph Warywoda, both of Chicago, Ill.

[73] Assignee: Bunker Ramo Corporation, Oak Brook, Ill.

[21] Appl. No.: 318

[22] Filed: Jan. 2, 1979

[51] Int. Cl.[3] ..... H01R 27/02

[52] U.S. Cl. ..... 339/91 R; 179/1 PC; 339/176 M; 339/154 A

[58] Field of Search ..... 339/97 R, 136 R, 154 R, 339/154 A, 176 M, 91 R, 103 R, 103 M, 18 R, 18 B; 179/1 PC

[56] References Cited

U.S. PATENT DOCUMENTS

| | | | |
|---|---|---|---|
| 2,714,195 | 7/1955 | Beatty | 339/45 |
| 2,930,019 | 3/1960 | Hubbell | 339/31 |
| 3,054,078 | 9/1962 | Baschkin | 339/18 |
| 3,090,027 | 5/1963 | Phillips et al. | 339/31 |
| 3,300,750 | 1/1967 | Harner et al. | 339/18 |
| 3,453,403 | 7/1969 | Hoffman | 200/57 |
| 3,471,822 | 10/1969 | Van Baelen | 339/18 R |
| 3,501,599 | 3/1970 | Horecky | 200/16 |
| 3,725,621 | 4/1973 | Kirchdorf | 200/46 |
| 3,760,336 | 9/1973 | Cerwin | 339/138 X |
| 3,803,530 | 4/1974 | Lapraik | 339/36 |
| 3,836,415 | 9/1974 | Hilderbrandt | 339/97 R X |
| 3,885,849 | 5/1975 | Bailey | 339/31 R |
| 3,936,129 | 2/1976 | Guy | 339/103 R |
| 4,061,411 | 12/1977 | Gumb et al. | 179/1 PC X |
| 4,070,548 | 1/1978 | Kasper | 179/1 PC |
| 4,090,764 | 5/1978 | Malsby et al. | 339/103 M |
| 4,103,985 | 8/1978 | Krolak et al. | 339/91 R X |

FOREIGN PATENT DOCUMENTS 15507 12/1971 Australia .

*Primary Examiner*—Roy Lake
*Assistant Examiner*—Eugene F. Desmond
*Attorney, Agent, or Firm*—F. M. Arbuckle; J. R. Hoffman

[57] ABSTRACT

A modularized electrical connector includes plural sets of electrical contacts carried by a support means. A first adapter plug having an associated set of electrical contacts is constructed and arranged for disposition in releasable electrical engagement with any selected set of the plural contact sets. A second adapter affixed to the support member is flexibly wired to the movable first adapter and includes an associated set of electrical contacts for electrical connection to a mating connector plug. A mounting member is provided for securing the first adapter in a selected position. Other features are disclosed.

8 Claims, 7 Drawing Figures

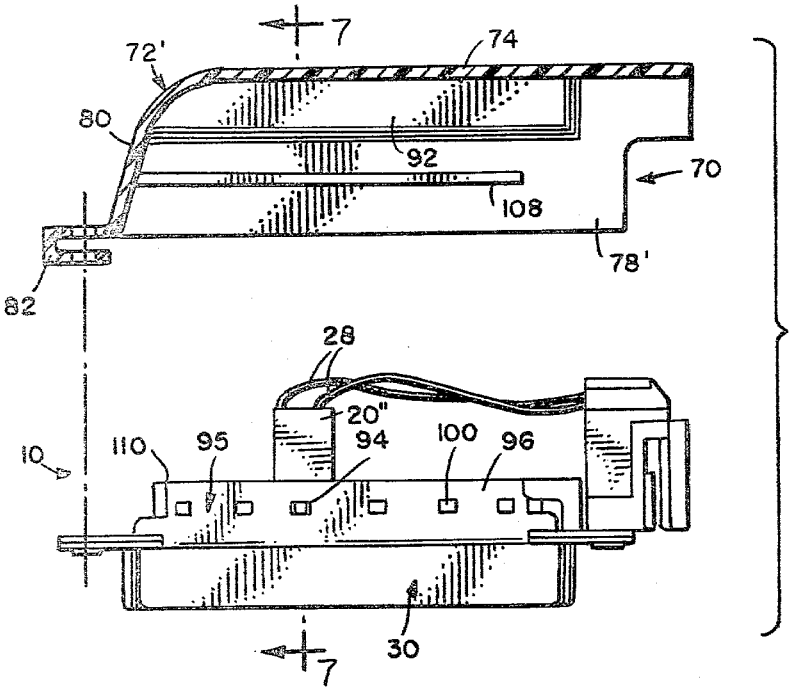
FIG. 6
FIG. 5
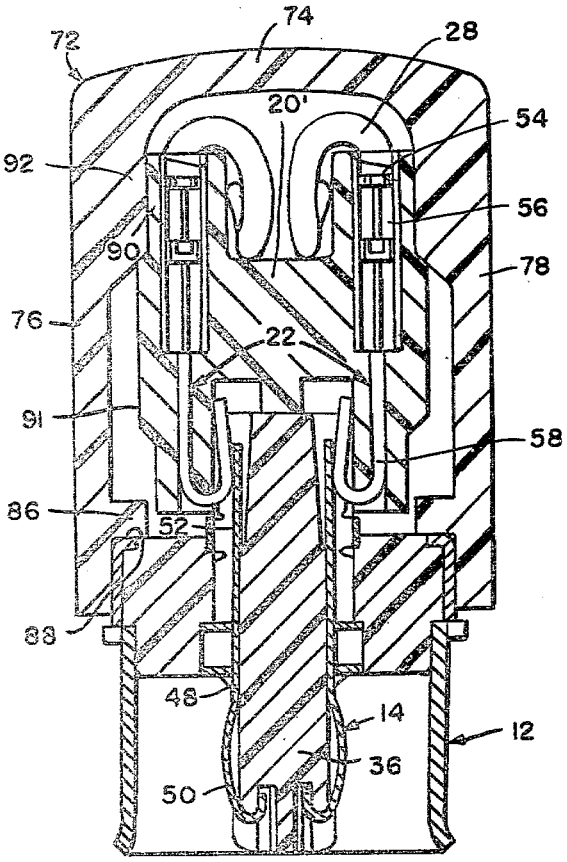
FIG. 7
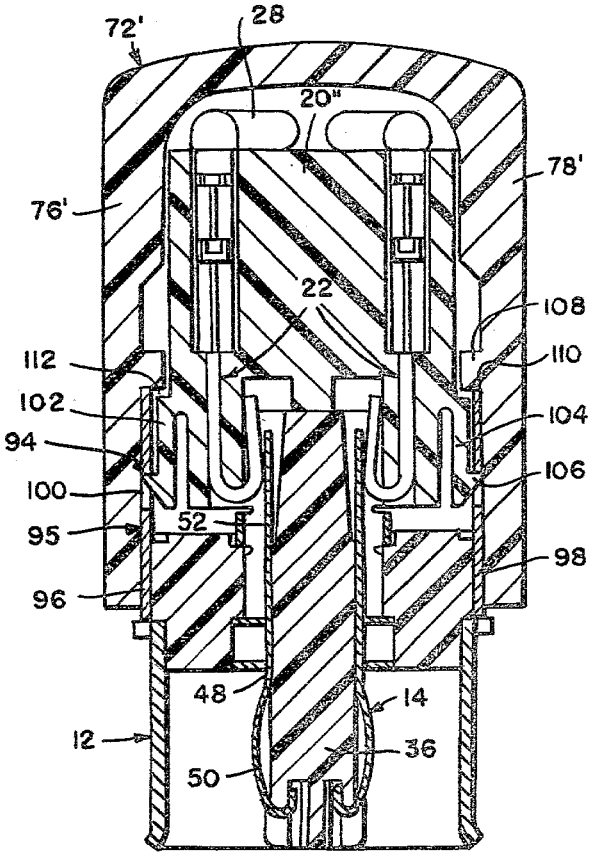

ELECTRICAL CONNECTOR

RELATED APPLICATION

This application is related to U.S. patent application Ser. No. 000,317, filed concurrently herewith in the name of Jiulio E. Perna et al, and assigned to the assignee of the present application.

BACKGROUND OF THE INVENTION

This invention relates generally to modular electrical connectors useful, for example, in telephone interconnection systems or the like. More particularly, the invention is directed to new and improved modular connector designs facilitating prompt field service connection and reconnection of electrical circuits in selected circuit patterns with a minimum of effort and time by relatively unskilled personnel.

In telephone interconnection systems and similar environments, individual telephones are required to have one or more specific features according to customer requirements, such as preselected telephone number, multiple-lines, a hold button, etc. The individual telephones must be joined to the system so as to accommodate these requirements. Often, however, these customer requirements change after a period of time necessitating a service call to reconnect the individual telephones into the system according to the new requirements. Heretofore, it has been commonplace to hand-wire and solder leads to the electrical connectors, and thus both installation and later reinstallations have required a tedious unsoldering and resoldering of wires to connector leads according to the modified requirements.

Modularization of telephone interconnection systems has become increasingly popular in order to reduce hardware requirements and the service expense inherent in performing individual conductor terminations. For these reasons, modularized or standardized telephone jack connectors are presently being incorporated into individual telephone units, and standardized telephone plugs have been adopted for terminating both ends of the telephone cord. The interconnection between the conductors and the telephone unit is then effected by the simple mating of a modular plug and jack. In addition, a variety of junction boxes, bridging adapters and other devices have been developed which incorporate modular jack connectors for receiving such plugs, the modular jack connector being prewired in accordance with the above to one or more standardized connectors disposed in the device. Such standard telephone plugs and jacks are known in the art and are described in the Federal Communications Commission Regulations published in the Federal Register, Monday, July 12, 1976.

In lieu of utilizing the above described pre-wired junction boxes and the like, a standardized connector already widely in use, such as the connector sold by Bunker Ramo Corporation under the trademarks "57" and "157" Series, may be individually adapted to the above modular concept and utilized in accordance with the previously described telephone interconnection technique. One form of such an adaptation is described in U.S. Pat. No. 4,070,548, issued Jan. 24, 1978, to Alan Henry Kasper and assigned to the assignee of the present invention. As disclosed in the aforementioned patent, plural conductors electrically interconnect the electrical contacts of the modular connector with one preselected set of contacts in the standardized connector which supports the modular connector, thereby electrically connecting the telephone unit with the desired signal outputs of the telephone switching equipment system. These conductors are generally soldered or otherwise permanently attached to both the modular connector and to the preselected set of contacts in the standardized connector.

It has been found desirable in some instances to eliminate the soldering or other permanent attachment of the conductors to the preselected set of contacts of the standardized connector as well as to provide a full complement of electrical contacts therein which are selectively and releasably engageable with the conductors. Such a capability would reduce the requirement of maintaining a large inventory of pre-wired connectors having different wiring arrangements. It would also eliminate the alternative procedure of detaching the permanently terminated conductors and resoldering them to a different set of contacts on the standardized connector in order to provide electrical interconnection between the single telephone unit and different signal outputs of the telephone signalling and switching system coupled to the standardized connector.

SUMMARY OF THE INVENTION

It is therefore a primary objective of the present invention to provide a new and improved electrical connector of modular design.

It is a further object of the present invention to provide an improved field serviceable electrical connector facilitating electrical connection of a standardized adapter element mounted thereon with any selected set of a plurality of sets of electrical contact sets supported by the connector.

It is a further object of the present invention to provide an electrical connector having a first adapter element releasably securable to any selected set of a plurality of sets of electrical contacts supported by the connector and further having a second adapter fixedly secured to the connector to enable prompt and easy coupling of any preselected set of the connector electrical contact sets to a standard modular adapter.

Accordingly, the invention is directed to an electrical connector comprising first contact means having plural sets of electrical contacts supported by a support means. A first adapter means is provided with an associated set of electrical contacts and is constructed and arranged for releasable electrical engagement with any selected set of the plural sets of contacts. A second adapter means is supported by the support means and includes an associated set of electrical contacts for electrical connection to a mating connector means. Conductor means are provided for electrically connecting the associated sets of contacts of the first and second adapter means.

In one preferred embodiment of the invention, mounting means are provided for releasably securing the first adapter means along the support means for electrical engagement with any one selected set of the plural sets of the first contact means.

BRIEF DESCRIPTION OF THE DRAWINGS

The novel features which are believed to be characteristic of the present invention are set forth in the appended claims. The invention itself, however, together with further objects and attendant advantages thereof, will become apparent and best understood by reference to the following detailed description taken in connection with the accompanying drawings, setting forth by way of illustration and example certain embodiments of the invention in the several figures of which like reference numerals identify like elements, and in which:

FIG. 5 is a cross-sectional view taken substantially along line 5—5 of FIG. 4 with the connector in its fully assembled position;

FIG. 6 is an exploded side elevational view, with some parts in cross-section, of a second embodiment of the present invention and particularly illustrating a second embodiment of the mounting means; and FIG. 7 is a cross-sectional view taken substantially along line 7—7 of FIG. 6 but showing the connector fully assembled.

DETAILED DESCRIPTION OF THE PREFERRED EMBODIMENT

Figure 1:
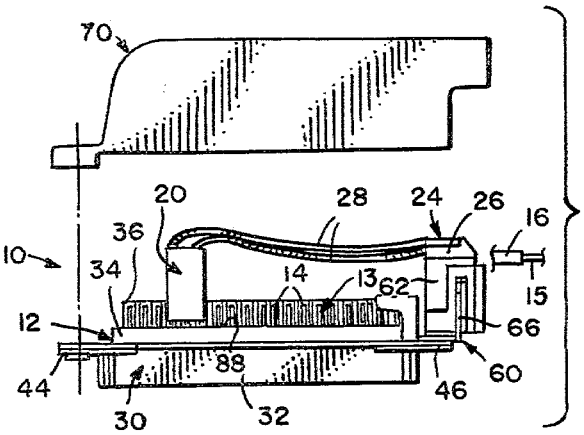
FIG. 1 is a partially exploded, side elevational view of one preferred embodiment of the modular connector of the present invention depicting in addition a mating connector about to be placed in engagement therewith.
Figure 2:
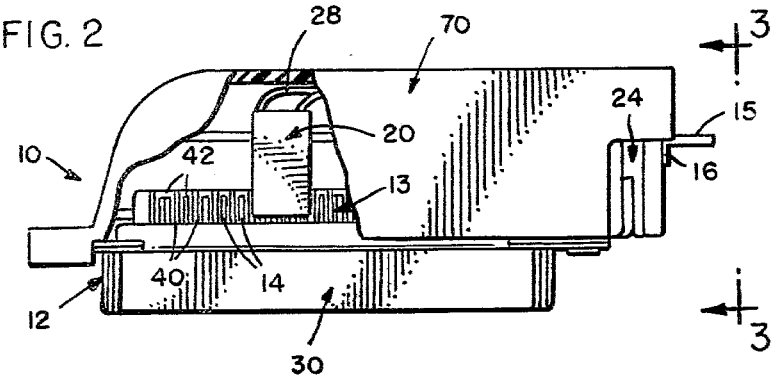
FIG. 2 is a side elevational view, with a portion of the cover broken away, of the connector of FIG. 1 in its fully assembled condition and illustrating the mating connector element engaged therewith.
Figure 4:
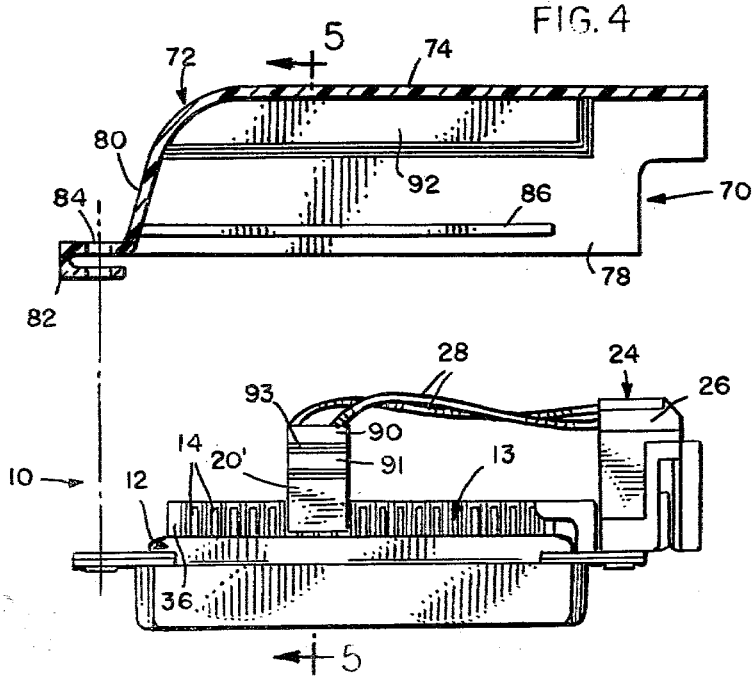
FIG. 4 is an exploded side elevational view, partly in section, of a connector of the present invention and particularly illustrating one embodiment of the mounting means of the invention.

Referring to FIGS. 1 and 2, a preferred embodiment of the connector of the present invention is generally designated by the numeral 10. The connector 10 is adapted for electrically interconnecting a single electrical appliance, and more particularly a single telephone unit, with any one of a plurality of signal outputs of an electrical telephone system coupled to the connector 10. In this respect, the connector 10 is related to the electrical connector described in U.S. Pat. No. 4,070,548, issued Jan. 24, 1978, to Alan Henry Kasper and assigned to the assignee of the present invention, and the disclosure of that patent is incorporated herein by reference.

As shown in the drawings, the electrical connector 10 includes a support means 12 and first contact means shown generally at 13. The first contact means 13 preferably includes a plurality of sets of electrical contacts 14 supported by the support means 12, as described in greater detail below. The lower extensions of the first contact means 13, concealed by the support means 12, are adapted to project into an open lower cavity of the support means for connection to a mating connector (not shown). The mating connector (not shown) includes a full complement of contacts for mating with each set of the plural contact sets of contact means 13. The mating connector (not shown) snugly interfits with the lower peripheral flange of the support means 12 in known fashion.

A single electrical appliance such as a telephone unit (not illustrated) is electrically coupled by a cable conductor 15 to a single standardized, single unit modular connector element 16. A primary purpose of the invention is to electrically interconnect the single unit modular element 16 with any one of a plurality of signal outputs of the electrical system coupled to the sets of electrical contacts 14. To achieve this purpose, a first adapter means 20 is provided, having an associated set of electrical contacts 22 (FIGS. 5 and 7). The adapter means 20 is constructed and arranged for disposition with its associated contacts 22 positioned in releasable electrical engagement with any selected set of the plural sets of electrical contacts 14. The contacts 22 are likewise electrically interconnectable with the single standardized connector element 16 through a second adapter means and flexible conductor means presently to be described. Mounting means, as illustrated in FIGS. 4–7 and as described in detail below, are provided for releasably securing the adapter means 20 along the support means 12 to provide firm electrical engagement between the contacts 22 and any selected set of the plural sets of contacts 14.

In one preferred embodiment of the invention, a second adapter means 24 is provided to electrically and mechanically couple the contacts 22 with the standardized connector element 16. The second adapter means 24 is carried by the support means 12 and is preferably in the form of a standardized adapter element 26 constructed to matingly receive and electrically engage the connector element 16. The second adapter element 26 includes an associated set of electrical contacts 27 (FIG. 3) for electrical connection to the like contacts of the connector element 16. The contact elements 27 are in turn coupled to the contact elements 22 by a conductor means which in the present case preferably constitutes flexible wires 28. In this manner, the adapter element 20 may be moved to any selected position along the support means 12 to engage a selected set of the contacts 14. This arrangement permits electrical interconnection between the connector element 16 and any selected signal output of an electrical system electrically coupled to the contacts 14.

Figure 3:
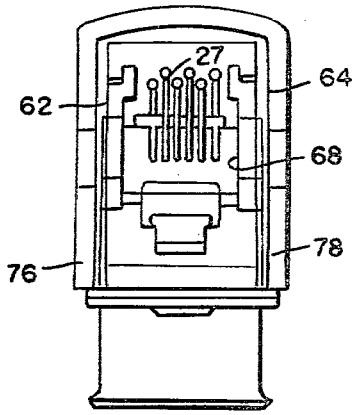
FIG. 3 is a rear elevational view of the fully assembled connector of FIG. 2 taken along lines 3—3 of FIG. 2.

Referring to the more specific structure of the connector 10 as illustrated in FIGS. 1–3, the support means 12 is preferably a standardized multi-contact connector unit sold under the trade name, Amphenol 57 Series or 157 Series, manufactured and distributed by the Amphenol North American Division of Bunker Ramo Corporation. In the preferred form, the support means 12 includes an elongated housing shell 30. The housing shell 30 is preferably substantially rectangular in shape, and includes a lower extending flange portion 32 adapted to define an interior elongated cavity for receiving a complementary mating connector (not illustrated). Such complementary mating connector is electrically engaged to an electrical system having a plurality of signal outputs, and the insertion of the complementary connector into the cavity defined by the lower portion 32, electrically couples such signal outputs to the contact elements 14 of the support means 12. An elongated dielectric body 36 is retained within the housing shell 30 and is adapted to support the electrical contacts 14. The insert 36 preferably includes a plurality of spaced barriers 40 which define a plurality of pairs of channels 42 for receiving and supporting the electrical contacts 14 in fixed positions in electrical isolation from one another and the metal shell housing 30. In addition, the shell 30 includes mounting flanges 44 and 46 projecting from its forward and rearward ends, respectively, for purposes to be described below.

Referring now to FIGS. 1, 5 and 7, the electrical contacts 14 preferably include a plurality of pairs of contact elements 48. Each contact element 48 includes an active contact portion 50 projecting into the cavity defined by the shell 30, and a terminal contact portion 52 projecting into a channel 42 of the insert 36. The contact elements 48 are preferably arranged in tandem pairs on either side of the insert 36 to thereby provide two rows of opposed, paired electrical contacts 14. A set of the electrical contacts 14 may comprise one or more pairs of the contact elements 48 depending on the number of functional requirements of the particular electrical appliance coupled to the connector element 16, as described above. Each function generally requires a single circuit represented by one pair of the contact elements 48, and when the electrical appliance comprises a single telephone unit, one of these functions consists of a telephone line circuit. Each pair of the contact elements 48 is also electrically engageable with a signal output of the electrical system to which the support means 12 is electrically engaged. Thus, a set of electrical contacts 14 may provide one or more functions represented by one or more signal outputs of the electrical system, and the pairs of contact elements 48 of each set of contacts 14 are preferably arranged adjacent each other.

The first adapter means 20 is provided to electrically interconnect any selected set of the contacts 14 with the standardized connector element 16. In the preferred embodiment, the single adapter element 20 consists of a single dielectric body constructed to straddle the insert 36 and define a plurality of channels 54 for mounting the electrical contacts 22. Each electrical contact 22 preferably includes a terminal contact portion 56 mounted in the upper portion of the adapter element 20, and an essentially J-shaped active contact portion 58 is disposed in the lower portion of the channel 54 for direct electrical engagement with a contact element 48. The number of contacts 22 disposed in the adapter element 20 may vary generally from one to four pairs of contacts 22, depending on the number of pairs of the contact elements 48 in one set of the contacts 14. The first adapter element 20 is preferably directly supported on the insert 36 and is positionable at any selected location therealong by the interengagement of the active contact portions 58 with respective active contact portions 52 within the appropriate insert channels 42. Mounting means, as described in greater detail below, may also be provided for firmly and releasably securing the adapter element 20 in position along the insert member 36.

A preferred embodiment of the invention, as illustrated in FIGS. 1–3, also includes the second adapter means 24. As previously mentioned, the second adapter means 24 preferably includes a second adapter element 26 sized and shaped to matingly receive the standardized connector element 16. However, an alternate embodiment (not illustrated) is envisioned wherein the first adapter element 20 may be constructed and arranged to directly matingly receive the standardized connector element 16 which would obviate the need for a separate second adapter element 26.

The second adapter element 26 is preferably directly supported on the support means 12 by a mounting bracket 60 secured to the flange 46. The bracket 60 preferably includes a pair of spaced side projections 66. The second adapter element 26 is constructed in the form of a single dielectric body which includes a pair of grooves in its respective sidewalls 62, 64 for receiving the side projections 66 of the bracket 60. In this manner, the second adapter element 26 may be slidably mounted to the bracket 60 and the support means 12.

The dielectric body of the second adapter element 26 supports the set of electrical contacts 27 and defines an aperture 68 for receiving the single standardized connector element 16. Each electrical contact 27 is adapted for electrical engagement with an electrical contact (not illustrated) in the single connector element 16 and is electrically engaged to an electrical contact 22 of the first adapter element 20 by one of the conductors 28. In preferred form, there are at least as many electrical contacts 22 in the first adapter element 20 as there are electrical contacts 27 in the second adapter element 26. Further details regarding the mounting bracket 60 may be found in the previously referenced and incorporated U.S. Pat. No. 4,070,548, and further details regarding the second adapter element 26 and the standardized connector element 16 may also be found in the same referenced patent as well as in the aforementioned Federal Communications Commission Regulations.

Referring now to FIGS. 4–7, mounting means are provided for releasably securing the first adapter means 20 in position along the support means 12 for electrical engagement with any one selected set of the plural sets of electrical contacts 14. In one embodiment of the invention illustrated in FIGS. 4 and 5, the mounting means includes a mounting member 70 which is engageable with both the support means 12 and the first adapter means 20 to securably hold the first adapter means 20 in any selected position on the support means 12. In the illustrated form of the invention, the mounting member 70 may conveniently comprise an elongated hood member 72 sized and shaped to concurrently provide environmental protection for the connector 10 as well as to secure the first adapter means 20 to any selected position on the support means 12.

The hood member 72 is preferably constructed from a relatively rigid material, such as metal or plastic, and includes a top wall 74, a pair of opposed sidewalls 76, 78, a front wall 80 and an open rear end. The top wall 74 is extended rearwardly to cover the upper portion of the second adapter element 26, and the sidewalls 76, 78 are sized to provide sufficient room within the hooded connector 10 for the first adapter element 20 and the conductors 28. The hood member 72 is slidably engageable with the support means 12 and includes a forwardly disposed member 82 which has a slot therein for receiving the forward flange 44 of the shell 30. An aperture 84 is provided within the forward member 82 for the insertion of a screw or like member to secure the flange 44 therewithin. Disposed on the lower inner surface of each sidewall 76, 78 is an elongated guide rail 86 for slidable engagement with the cooperating upper ledge 88 of the shell's top portion 34.

In this particular embodiment of the invention, the first adapter element 20' includes on either side thereof a recessed portion 90, an adjacent land surface 91, and a shoulder 93 therebetween. Disposed on the upper inner surface of each sidewall 76, 78 of the hood member 72 is an elongated embossment 92 which is slidingly engageable within the recessed portion and against the shoulder 93 of the first adapter element 20'. In this manner, when the first adapter element 20' is positioned along the support means 12 to electrically engage a selected set of the electrical contacts 14, the embossments 92 slidably engage the sidewalls of the first adapter element 20' within the recessed portions 90 as the hood member 72 is slidably engaged with the support means 12, thereby acting to hold the first adapter element 20' in its selected position.

Referring to FIGS. 3, 6 and 7, a second embodiment of the mounting means of the invention is disclosed. In this embodiment of the invention, the mounting means includes detent means 94 for positively indexing the first adapter means 20'' with the support means 12 at each of a plurality of locations defined by the plurality of sets of electrical contacts 14. In one form of the invention, the detent means 94 may consist of a plurality of interengageable indexing elements disposed opposite each other on the support means 12 and the first adapter means 18. To provide such interengageable indexing elements, the support means 12 includes a support member 95 which is preferably an elongate upward extension of the shell 30. The support member 95 includes opposing sidewalls 96 and 98 on either side of the insert member 36. Spaced longitudinally along each sidewall 96 and 98 are a plurality of window apertures 100 positioned opposite each other, each pair of opposed apretures 100 being associated wih one set of the contacts 14. The spacing of the window apertures 100 may vary depending on the number of pairs of contact elements 48 in each set of electrical contacts 14. The greater the number of pairs of contact elements 48 in each set of the contacts 14, the greater the distance between adjacent window apertures 100.

Disposed on either side of the first adapter element 20'' opposite the support member sidewalls 96, 98 are resilient latching members 102. Each latching member 102 includes a latching arm 104 disposed adjacent the opposing sidewall 96 or 98 and a latching element 106 mounted at the end thereof for engagement within a window aperture 100. The latching arm 104 is biased outwardly away from the adapter element 20'' so as to maintain its latching element 106 within a window 100 when the arm 104 is aligned opposite therefrom. The latching element 106 may be removed from its engaged aperture 100 by displacing the resilient arm 104 inwardly toward the first adapter element 20''. In this manner, when the first adapter element 20'' is engaged with a set of the electrical contacts 14, the latching elements 102 engage the window apertures 100 associated with that particular set of electrical contacts 14. When it is desired to move the first adapter element 20'' for engagement with a different set of the electrical contacts 14, the latching arms 104 are depressed inwardly, and the first adapter element 20'' is moved upwardly relative to the support means 12 to disengage its contacts 22 from the set of contacts 14. The first adapter element 20'' is then moved to a new position along the support means 12 with the latching element 102 being aligned with another set of the window apertures 100.

In this second embodiment of the mounting means, the hood member 72' includes a longitudinal guide rail 108 on the inner surfaces of its sidewalls 76', 78' for engagement with the upper longitudinal edges 110 of the support member sidewalls 96, 98. In addition, the guide rails 108 project sufficiently inwardly to overlap the upper portion 112 of the latching members 102 to insure against inadvertent disengagement of the latching elements 106 from the window apertures 100 and dislodging of the first adapter element 20'' from its engaged position with a set of the electrical contacts 14.

As can be seen from the above, the present invention provides an electrical connector capable of electrically interconnecting a single electrical appliance, such as a telephone unit, with any one of a plurality of signal outputs of an electrical system coupled to the connector. The connector of the invention permits the selective changing of the electrical interconnection between the appliance and the various available signal outputs of the system without disconnecting the connector from the system as well as without disconnecting and reattaching the conductors within the connector itself. The connector of the invention more particularly provides an adapter for use with a standardized multi-contact connector unit for selectively engaging any desired set of the plural sets of contacts within the standardized unit. This arrangement may then be utilized to interconnect a single standardized connector element coupled to an electrical appliance with an electrical system's signal outputs. Thus, standardized and modular connector components presently being utilized in the telephone interconnection art may be coupled to the connector of the present invention without adjusting or changing connections of the conductors within the connector. As a result, changing of telephone line circuits leading to a single telephone unit may be performed in the field and be effected quickly, easily and without the use of tools. Finally, the possibility of damaging the conductors and the electrical contacts within the connector when changing such circuits is eliminated in the present invention since the conductor terminations therein are not altered. This advantageous feature reduces the cost and complexity of rearranging circuits from telephone signalling and switching systems to individual telephone units.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

We claim:

1. An electrical connector for mating with a complementary connector having a plurality of fixed contact elements, comprising:

support means;

first adapter means, including an associated set of electrical contacts lesser in number than the contacts of said complementary connector, constructed and arranged for disposition at any preselected one of a predetermined plurality of positions on said support means, for adapting the electrical connector for mating engagement with only selected ones of the fixed contact elements of said complementary electrical connector according to the position of said first adapter means on said support means to change the circuit through the connectors;

complementary mounting means on said support means and said first adapter means for releasably securing said first adapter means at any one of said preselected positions;

second adapter means, including an associated set of electrical contacts, supported by said support means in a fixed position for mating engagement with selected contact elements of a second complementary electrical connector; and conductor means for electrically interconnecting said associated sets of electrical contacts of said first and second adapter means.

2. The electrical connector as described in claim 1, wherein said mounting means comprises a mounting member engageable with said support means and said first adapter means.

3. The electrical connector as described in claim 1, wherein said mounting means comprises a hood member slidably engageable with said support means and said first adapter means and adapted for concurrently providing environmental protection for said first contact means and said contacts of said first adapter means while securing said first adapter means at any said position on said support means.

4. The electrical connector as described in claim 3, wherein said first adapter means comprises an adapter element having opposide sidewalls defining recessed portions therein, and wherein said hood member includes a pair of spaced sidewall members and engaging means disposed on the opposed inner surfaces of said sidewall member for engaging said recessed portions of said opposed sidewalls.

5. The electrical connector as described in claim 1, wherein said mounting means comprises detent means for positively indexing said first adapter means with said support means at each of a plurality of locations defined by said plural sets of contacts of said first contact means.

6. The electrical connector as described in claim 5, wherein said support means includes an elongate support member, and wherein said indexing means comprises a pair of spaced sidewalls extending from said support member and defining a plurality of paired, opposed apertures at spaced locations therealong, and a pair of resilient latching members disposed on opposite sides of said first adapter means for location within a respective pair of said apertures for securely latching said first adapter means to said support means, said latching members being resiliently displaceable out of engagement with said apertured sidewalls to permit movement of said first adapter element to another selected location.

7. The electrical connector as described in claim 1, wherein said support means comprises a metallic housing element and a dielectric insert element disposed within said housing element for supporting said first contact means in electrical isolation from said housing element.

8. The electrical connector as described in claim 7, wherein said housing element is an elongate shell peripherally enclosing said insert element, and wherein said plural sets of contacts of said first contact means are arranged in tandem along the length of said insert element.

* * * * *